United States Patent [19]

Moelders

[11] 3,969,226

[45] July 13, 1976

[54] HORIZONTAL DRUM-TYPE MAGNETIC SEPARATOR FOR GRANULAR FEEDS

[75] Inventor: Johann Moelders, Bergisch-Gladbach, Germany

[73] Assignee: Berger Maschinenfabriken G.m.b.H. & Co., Bergisch-Gladbach, Germany

[22] Filed: Mar. 28, 1974

[21] Appl. No.: 455,859

[30] Foreign Application Priority Data

Mar. 28, 1973 Germany ..... 2315451

[52] U.S. Cl. ..... 209/39; 209/225

[51] Int. Cl.[2] ..... B03C 1/14

[58] Field of Search ..... 209/221, 225, 11, 284, 209/294, 224, 223 R, 226, 39, 40

[56] References Cited

UNITED STATES PATENTS

| | | | |
|---|---|---|---|
| 348,121 | 8/1886 | Gilbert | 209/221 |
| 470,456 | 3/1892 | Thompson | 209/225 |
| 1,441,870 | 1/1923 | McGraw | 209/284 |
| 1,472,204 | 10/1923 | Brewer | 209/284 |
| 2,652,588 | 9/1953 | Harris | 209/294 X |
| 3,021,951 | 2/1962 | Kult | 209/221 |
| 3,073,449 | 1/1963 | Johanningmeier | 209/11 X |
| 3,463,314 | 8/1969 | Feterl | 209/284 |

FOREIGN PATENTS OR APPLICATIONS

| | | | |
|---|---|---|---|
| 5,568 | 1/1927 | Australia | 209/221 |
| 725,110 | 2/1932 | France | 209/224 |
| 940,055 | 5/1948 | France | 209/221 |
| 11,829 | 6/1880 | Germany | 209/221 |
| 206,610 | 11/1923 | United Kingdom | 209/224 |
| 11,690 | 6/1891 | United Kingdom | 209/221 |

*Primary Examiner*—Robert Halper
*Attorney, Agent, or Firm*—Hamilton, Renner & Kenner

[57] ABSTRACT

A horizontal drum-type magnetic separator for granular feeds of magnetic and nonmagnetic materials utilizing a drum rotatable about an axis of rotation into which granular feeds are infed. A magnetic field is created as by a plurality of magnets disposed about the outer periphery of the drum. A first chute is provided within the drum for collecting the nonmagnetic material as the granular feed passes through the magnetic field and a second chute is provided for collecting the magnetic material after the granular feed passes through the magnetic field.

10 Claims, 3 Drawing Figures

HORIZONTAL DRUM-TYPE MAGNETIC SEPARATOR FOR GRANULAR FEEDS

BACKGROUND OF THE INVENTION

This invention relates to a drum-type magnetic separator of horizontal arrangement to handle mixed granular feeds in which the feed material is deposited on the drum shell and moves through a magnetic field of stationary magnets. The nonmagnetic particles are separated during movement through the magnetic field and the magnetic material falls away from the collecting surface after passage through the magnetic field.

Prior art stationary-magnet drum separators have a cylindrical drum member within which a magnet bank is fixed. During rotation of the drum shell about the magnet bank the separated metallic particles are moved into a discharge hopper with the aid of scraping flights. A feeder is arranged ahead of the drum inlet and batches the material by volumetric control, distributing it in a uniform layer over the width of the collecting surface of the drum. When the drum rotates, the nonmagnetic particles within the layer of material slide off the collecting surface into a chute and the magnetic constituents likewise slip off the collecting surface of the drum shell when they have passed through the magnetic field and drop into a suitably designed discharge hopper.

The main disadvantage of such separating apparatus is that the entire feed material to be treated has to be distributed over the peripheral collecting surface of the drum and pass through the magnetic field, which reduces the throughput rate, especially in the case of feeds having a high content of nonmagnetic material, such as sand. As both the feeder and discharge device must be outside the drum, the former above and the latter below the collecting surface, the overall height of the apparatus is fairly considerable and only a short drop remains from the drum shell for the separated particles. A further drawback is that the centrifugal force generated as the rotational speed of the drum is increased counters the effect of magnetic adhesion, so that frequently magnetic particles fall away and are lost. This discharge by acquired momentum is intensified by the radial acceleration induced by the scraping flights. Further, variation in the bulk density of the feed causes the driving torque of the drum to fluctuate, thereby giving rise to stalling of the motor or belt slippage.

SUMMARY OF THE INVENTION

The object of the invention is to obviate these disadvantages, for the purpose of which the magnets are disposed about the external periphery of the drum, the material is fed into the interior of the drum, below the axis of rotation, and the separated materials are discharged into chutes arranged substantially above the drum axis, one of said chutes being below the end of the magnets and the other, viewed in the direction of drum rotation, at the back thereof, i.e., beyond it.

With the apparatus taught by the invention, the material to be separated is fed onto the inner wall of the drum in the range of the magnets, so that with the upward movement of the collecting surface for the most part only the magnetic particles are entrained and the nonmagnetic constituents slide down and can be discharged, without passing through the magnetic field. The apparatus can be of very low overall height as the material feeder and product discharge means can be on one and the same level. There is no need for a separate batching device for the feed. The centrifugal forces generated by the drum rotation supplement the magnetic adhesion instead of reducing it and the driving torque is practically unchanged, as only the concentrate adheres to and is entrained on the inside wall of the drum.

The apparatus can be constructed to take account of desired throughput rates and degree of concentration by increasing the drum length, without adding to the overall height, whereas, with prior art apparatus, to improve the quality of separation, a plurality of magnetic drums arranged one above the other is required.

Various other objects and advantages will appear from the following description taken in conjunction with the attached drawings, and the novel features will be particularly pointed out hereinafter in conjunction with the appended claims.

DESCRIPTION OF THE PREFERRED EMBODIMENT

Figure 1:
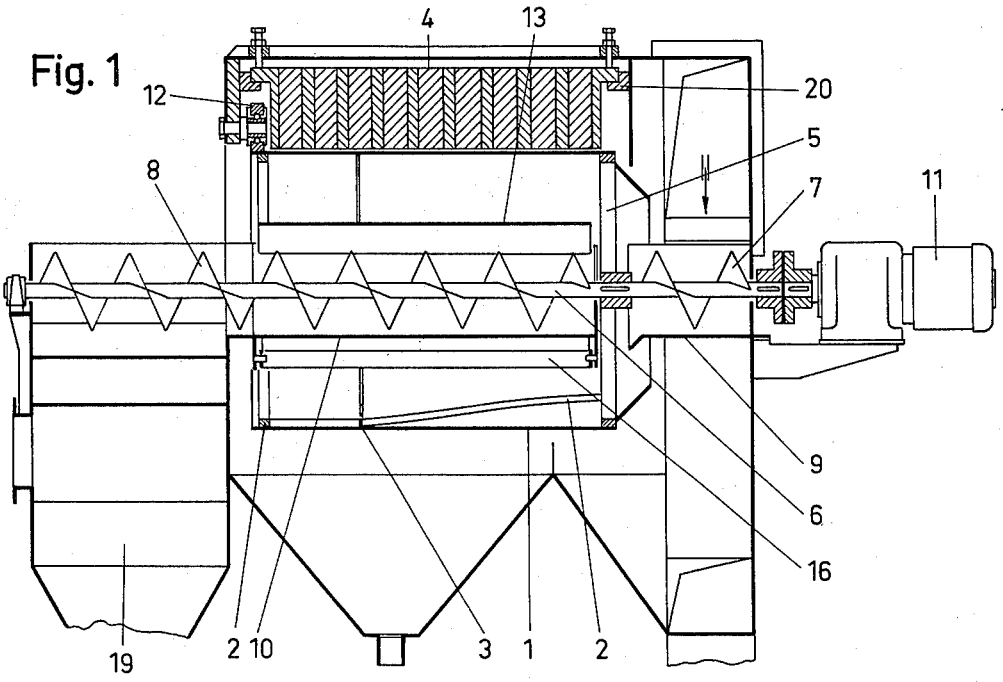
FIG. 1 is a somewhat schematic arrangement of the apparatus taken substantially in longitudinal section.
Figure 2:
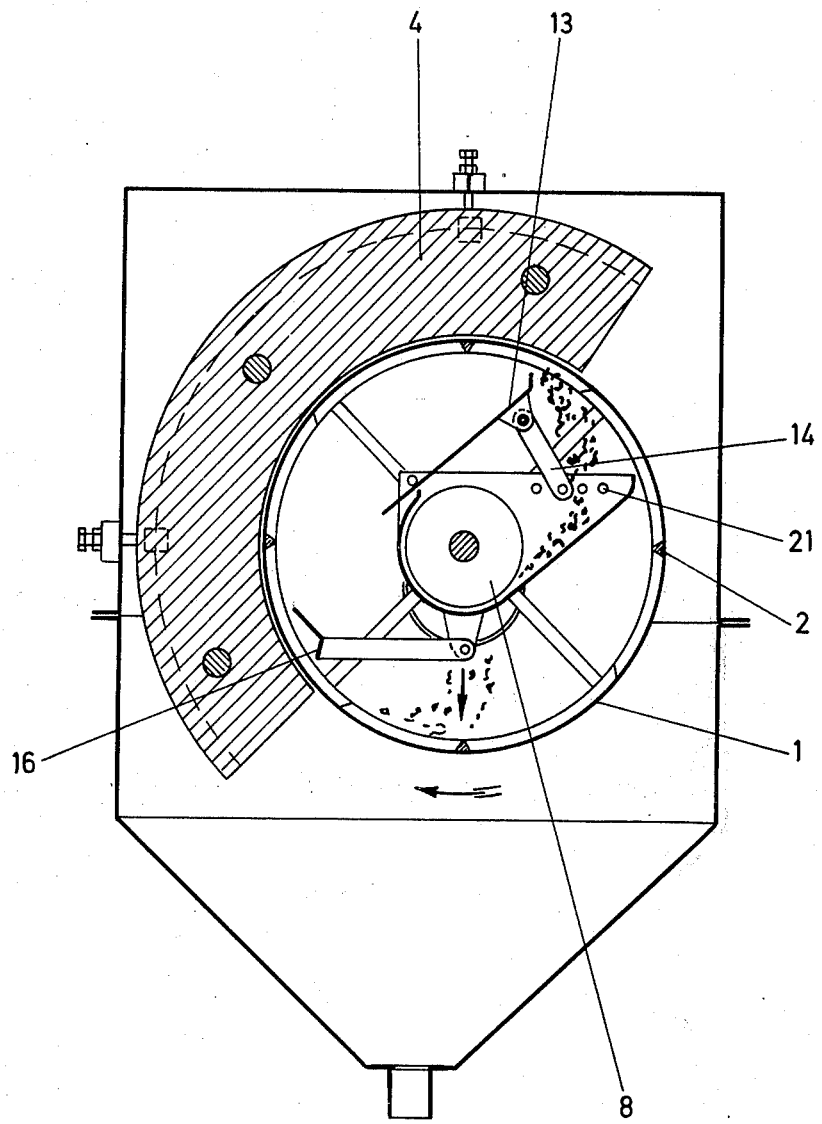
FIG. 2 is a cross section through the drum of the apparatus viewed from the outlet side of the drum or left side of FIG. 1; and, FIG. 3 is a cross section through the air classifier on the outlet side of the drum.

The apparatus, schematically depicted in FIG. 1, has a drum which is constituted of a generally cylindrical shell 1, with a plurality of flight members 2 disposed about its inner surface. Preferably the flight members 2 should be of helical configuration, so as to impart a thrusting action to the material in the direction of discharge. To prevent rapid discharge of the material one or more annular control rings 3, which are of approximately the same height as the flight members 2, are provided in what may be termed a discharge zone. As shown in FIG. 2, the magnet 4 is concentrically and adjustably located in relation to the drum shell 1 and extends over approximately half the shell's diameter. The magnet 4 may be displaced in guides 20. Viewed in the direction of drum rotation, the lower end of the magnet is at a variable distance from the feed inlet, which is at the lowest point of the drum.

At the inlet end of the drum shell 1 is a hub which is connected with the drum shaft 6 through a spider 5. At the inlet end said drum shaft 6 mounts an infeed screw conveyor 7 and at the discharge end an outfeed screw conveyor 8. The infeed conveyor 7 receives the granular feed from a cone-shaped inlet mounted outside of the drum shell 1 and above the conveyor 7. A screw trough 9 and a chute 10 project from both ends into the interior of the drum. Stationary chutes can be employed instead of the screw conveyors. The driving motor 11 for the screw conveyors is flange-mounted to the end of the drum shaft 6. At the discharge end the drum shell 1 is open to permit ready accessibility. At the open end the drum is mounted in adjustable rollers 12 as depicted in FIGS. 1 and 3.

A divider or chute 13, connected to a lever 14, is provided to separate remaining nonmagnetic material from the magnetic material. The lever 14 is engagable with notches 21 in the chute 10 for adjustably positioning the upper edge of the divider 13 with respect to the drum shell 1. Adjustment is effected by means of a sideways-projecting hand lever 15.

A resilient scraper 16 extends the length of the drum shell 1 and is provided to regulate the infeed from the inlet and throughout the length of the drum. It is linked with the chute 10 and presses flexibly against the inside of the drum shell 1. As a rule the effective edge of the scraper is approximately of the same height as the lower end of the magnet 4. This scraper is also adjustable by means of an externally located lever 17 which rests on an adjustable slotted support 18.

Figure 3:
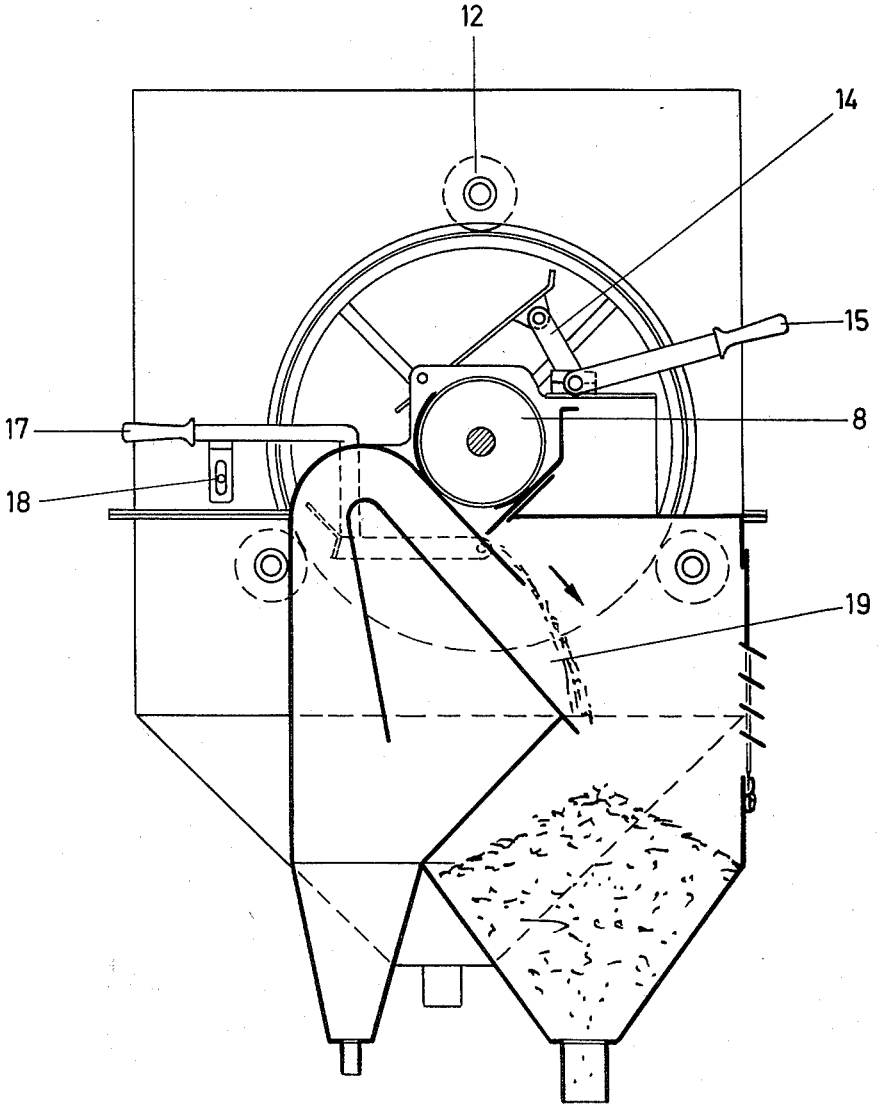

The apparatus may additionally include an air classifier 19 on the discharge end of the magnetic separator, as depicted in FIGS. 1 and 3. Magnetic material is fed thereto via discharge screw conveyor 8.

What is claimed is:

1. A drum-type magnetic separator for granular feeds of magnetic and nonmagnetic materials comprising: a rotatable drum having an axis of rotation, means for feeding the granular feeds into said drum, means for regulating infeed of the granular feed inside and throughout the length of said drum, means to adjust the position of said regulating means with respect to the inner surface of said drum, means for thrusting the granular feed of magnetic and nonmagnetic material thru said drum means for creating a magnetic field disposed about a portion of the outer periphery of said drum, a first chute located substantially above said axis of rotation and below said means for creating a magnetic field for collecting any nonmagnetic material carried with the magnetic material above said axis of rotation, a second chute extending substantially radially of said axis of rotation and having an opening above said axis of rotation and behind said first chute for collecting the magnetic material after the granular feed passes through the magnetic field, and means for adjusting said first chute with respect to said second chute and the inner surface of said drum.

2. A drum-type magnetic separator as set forth in claim 1, wherein the means for creating a magnetic field comprises: a plurality of magnets forming a semicircular bank disposed about the circumference of said drum, said magnets being positioned immediately above the lowest point of the periphery of said drum and terminating just beyond the uppermost point of the periphery of said drum.

3. A drum-type magnetic separator as set forth in claim 2, wherein said magnets are concentrically adjustable in relation to said drum.

4. A drum-type magnetic separator as set forth in claim 1, wherein said means for thrusting includes a plurality of helical flight members and at least one annular control ring on said inner surface of said drum.

5. A drum-type magnetic separator as set forth in claim 1, further comprising: a screw feeder coaxially aligned with said axis of rotation and having a first and second section, said first section being for the feeding of the granular feed and said second section being for the discharge of the separated magnetic material.

6. A drum-type magnetic separator as set forth in claim 5, wherein said second section of said screw feeder projects beyond the end of said drum and discharges the magnetic material into an air classifier.

7. A drum-type magnetic separator as set forth in claim 5, wherein said drum and said screw feeder are mounted on a common driving shaft.

8. A drum-type magnetic separator as set forth in claim 6, wherein one end of said drum is mounted on a spider secured to said drum shaft and the other end of said drum is mounted in a plurality of adjustable rollers.

9. A drum-type magnetic separator as set forth in claim 1, wherein said means for feeding the granular feeds into said drum includes a cone-shaped inlet mounted outside of said drum for receiving and feeding the granular feed material into said drum below said axis of rotation.

10. A drum-type magnetic separator as set forth in claim 1, wherein said means for regulating infeed of the granular feed inside said drum is a resilient scraper.

* * * * *

UNITED STATES PATENT OFFICE

CERTIFICATE OF CORRECTION

PATENT NO. : 3,969,226

DATED : July 13, 1976

INVENTOR(S) : Johann Moelders

It is certified that error appears in the above-identified patent and that said Letters Patent are hereby corrected as shown below:

Claim 8 (formerly claim 7) was dependent on former claim 6. Former claim 6 was renumbered as claim 7. Therefore, dependency in claim 8 should refer to claim 7.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*